US006083105A

United States Patent [19]

Ronin et al.

[11] Patent Number: 6,083,105

[45] Date of Patent: Jul. 4, 2000

[54] COMPUTERIZED ROULETTE PLAYING APPARATUS FOR A SINGLE PLAYER

[75] Inventors: Paul Ronin, 67 Colorados Dr., Millbrae, Calif. 94030; Mikhail Spitkovsky, Sunnyvale, Calif.; Jozef Galanter, San Francisco, Calif.; Ilya Ronin, San Jose, Calif.

[73] Assignee: Paul Ronin, Millbrae, Calif.

[21] Appl. No.: 09/133,901

[22] Filed: Aug. 13, 1998

[51] Int. Cl.[7] ..... A63F 5/02; A63F 9/24

[52] U.S. Cl. ..... 463/17; 463/16; 273/142 R; 273/142 E; 273/142 F; 273/142 G

[58] Field of Search ..... 273/142 R, 142 E, 273/142 F, 142 G, 142 B, 138.2; 463/16–17

[56] References Cited

U.S. PATENT DOCUMENTS

| | | | |
|---|---|---|---|
| 4,095,795 | 6/1978 | Saxton et al. | 273/143 R |
| 4,240,536 | 12/1980 | Noell, Jr. | 194/1 K |
| 4,334,679 | 6/1982 | Doyle et al. | 273/1 E |
| 4,396,193 | 8/1983 | Reinhardt et al. | 273/142 B |
| 4,601,470 | 7/1986 | Kadota et al. | 273/142 E |
| 4,643,425 | 2/1987 | Herzenberger | 273/142 |
| 4,732,385 | 3/1988 | Castellanos | 273/142 B |
| 4,754,980 | 7/1988 | Torgow | 273/356 |
| 4,906,005 | 3/1990 | Manable | 273/142 |
| 4,989,873 | 2/1991 | Manabe | 273/142 R |
| 5,697,611 | 12/1997 | Kelly et al. | 273/126 A |
| 5,743,798 | 4/1998 | Adams et al. | 463/17 |
| 5,755,440 | 5/1998 | Sher | 273/142 E |
| 5,775,993 | 7/1998 | Fentz et al. | 463/17 |
| 5,827,119 | 10/1998 | Bromley | 463/7 |
| 5,836,583 | 11/1998 | Towers | 273/142 B |
| 5,879,235 | 3/1999 | Kaneko et al. | 463/34 |
| 5,934,999 | 8/1999 | Valdez | 463/17 |

*Primary Examiner*—Jessica J. Harrison
*Assistant Examiner*—Carmen D. White

[57] ABSTRACT

A roulette playing machine which is designed for an individual player with the use of a single circulating playing ball. The machine comprises: an enclosed casing; a roulette wheel rotationally installed in the aforementioned casing and closed from above with a transparent cover that allows observation of the game but prevents physical contact with the playing ball; a drive mechanism for rotating the wheel that can be disengaged from the wheel to put it into free rotation after acceleration of the wheel, the wheel having circumferentially-arranged recesses for the playing balls and the inclined surface that ensures falling of the ball into one of the recesses when the wheel stops; electromagnetic mechanism for launching the ball in the direction of rotation of the wheel into a space between the wheel and the transparent cover; an electromechanical ball returning mechanism for returning the ball to the launching mechanism by means of an electromagnet and a lever system upon completion of one playing cycle; and a CPU that controls the operation of aforementioned mechanisms in accordance with the program. The apparatus also contains a sensor that immediately cancels the game cycle if the housing of the apparatus is intentionally or accidentally shaken to the extent that may change the game result. The invention also relates to a game based on the use of the aforementioned apparatus. The apparatus may be used in different modes with mechanical rotation of the roulette wheel or electronic simulation of the wheel on the display screen. The apparatus may standby in an attraction mode which is switched over to a game mode after loading money into a bill validator or a coin acceptor.

18 Claims, 17 Drawing Sheets

SOFTWARE ORGANIZATION FLOWCHART

Operator Mode -- Main Menu

---

1. Maintenance
2. Betting History
3. Coin Dispenser
4. Stacker/Coin Collector
5. Last Balance
6. Help
7. Restart the Program
0. MS-DOS Prompt

FIG.7

COMPUTERIZED ROULETTE PLAYING APPARATUS FOR A SINGLE PLAYER

FIELD OF THE INVENTION

The present invention relates to gambling and, more particularly, to a single-player computerized electromechanical roulette playing apparatus and games based on the use of this apparatus.

BACKGROUND OF THE INVENTION

At the present time there exists a great variety of gambling games and gambling machines. So-called roulette playing apparatuses constitute a large group of these machines. In general, a roulette-type machine consists of a roulette wheel having a plurality of circumferentially arranged recesses for receiving a playing ball which is thrown onto the rotating wheel manually by a croupier in the direction of rotation of the roulette wheel. The speed of the rotation of the disk decreases and, when the disk is finally stopped, the playing ball falls into the nearest recess. Each recess has a predetermined number that defines the value of the win.

With the development of computers, microprocessor-controlled roulette playing devices came into use. One such apparatus is described in U.S. Pat. No. 4,643,425 issued on Feb. 17, 1987 to M. Herzenberger. This apparatus comprises, a box-like body, a roulette wheel rotatingly installed in the body and including a plurality of numbered sectors, an electric motor for driving the wheel, launching assembly to be operated by a player to launch a ball into the roulette wheel, a playing selecting keyboard to be actuated by the player for defining the stake value, and a ball position sensing optical encoder for sensing the position of the ball on the roulette wheel. The apparatus also has an inlet channel for introducing tokens in order to set stake value, a token supplying hopper for supplying a predetermined number of tokens in the case of a win by the player, and a microprocessor circuit operatively coupled to all of the aforementioned elements for controlling their operation.

The apparatus of U.S. Pat. No. 4,643,425 is designed for participation in the game of several players simultaneously. Even though an individual may play alone, another player may come and join the game. In some cases, however, a player wants to play privately without the presence of other people. This is because the gambling that involves spending money may be associated with emotional factors such as superstition. In other cases the gambling machine may be located in a limited space where there is no enough room for several people.

Another disadvantage of the aforementioned device is that launching of the ball is performed manually and the force that expels the ball depends purely on the manual manipulations of the player. This means that after gaining an experience with the gambling machine, the player may control his/her launching effort to control the hit of the ball. Although it is not easy but is possible to some extent.

The apparatus of U.S. Pat. No. 4,643,425 has a keyboard token input which does not allow to use all possible combinations of betting, e.g., placing a token in a common point of two or four adjacent betting marks. What is meant is a case when a token is placed on a common side of two adjacent betting marks or in a point that covers four corners of four betting marks at the same time.

If the apparatus is not rigidly secured, it can be accidentally or intentionally shaken during movement of the ball, and this will change the result. The apparatus of U.S. Pat. No. 4,643,425 has no means for disabling the results of such an unforeseen action. In other words, the aforementioned apparatus involves a human factor that affects the results of the game.

U.S. Pat. No. 4,906,005 issued to K. Manabe in 1990 discloses a roulette-type gambling machine in which the launching of the ball and the results of the hit are fully automated and are free of the effect of the human factor on the results of the game. This machine includes an automatic ball launching device consisting of a pair of disks rotating in opposite directions with a ball between them. As a result, the ball is expelled onto a rotating wheel while spinning around its own axis. A release device for feeding a ball to the hitting device comprises a blower for sending forth air to the outlet through a release passage upstream of the outlet. The apparatus also has a feeder for feeding balls one by one to the release passage. Such arrangement enables the ball released on the circular runway to be accelerated thereon. The roulette wheel is rigidly fixed to the output shaft of a motor that rotates the roulette wheel.

A provision of the blower makes the machine complicated in structure, and the return of the balls to the hitting device is unreliable. The roulette wheel is rigidly connected to the shaft of the drive motor. This means that if a very experienced and technically knowledgeable fraudster can manage to control the speed of rotation of the motor with a sophisticated remote-control device, he/she would be able to control the results of the game. Furthermore, this machine does not exclude other players from participation in the game played by a single player. The description of U.S. Pat. No. 4,906,005 does not teach the way of betting but only describes the operation of the mechanisms of the machine.

OBJECTS OF THE INVENTION

It is an object of the present device to provide a roulette playing apparatus which is simple in construction, inexpensive to manufacture, is designed for participation of an individual player, allows to play in a limited space, excludes a human factor in launching a ball, allows to cover several bet marks with a single token, discontinues the game immediately upon accidental or intentionally shaking of the apparatus during movement of the ball, does not need the use of air under pressure for releasing the balls and feeding it to the hitting device, allows free rotation of the roulette wheel independent of the drive motor thus making unable a remote control of the rotation of the wheel by a fraudster.

These and other features and advantages of the apparatus of the invention will become apparent after the consideration of the ensuing description wih the accompanying drawings.

BRIEF DESCRIPTION OF THE DRAWINGS

FIG. 7 is a view of a display of the apparatus in a maintenance mode.

SUMMARY OF THE INVENTION

A roulette playing machine which is designed for an individual player with the use of a single circulating playing ball. The machine comprises: an enclosed casing; a roulette wheel rotationally installed in the aforementioned casing and closed with a transparent cover that allows observation of the game but prevents physical contact with the playing ball; a drive mechanism for rotating the wheel that can be disengaged from the wheel to put it into free rotation after acceleration of the wheel, the wheel having circumferentially-arranged recesses for the playing balls and the inclined surface that ensures falling of the ball into one of the recesses when the wheel stops; electromagnetic mechanism for launching the ball in the direction of rotation of the wheel into a space between the wheel and the transparent cover; an electromechanical ball returning mechanism for returning the ball to the launching mechanism by means of an electromagnet and a lever system upon completion of one playing cycle; and a CPU that controls the operation of aforementioned mechanisms in accordance with the program. The apparatus also contains a sensor that immediately cancel the game cycle if the housing of the apparatus is intentionally or accidentally shaken to the extent that may change the game result. The invention also relates to a game based on the use of the aforementioned apparatus. The apparatus may be used in different modes with mechanical rotation of the roulette wheel or electronic simulation of the wheel on the display screen. The apparatus may standby in an attraction mode which is switched over to a game mode after loading money into a bill validator or a coin acceptor.

Figure 1:
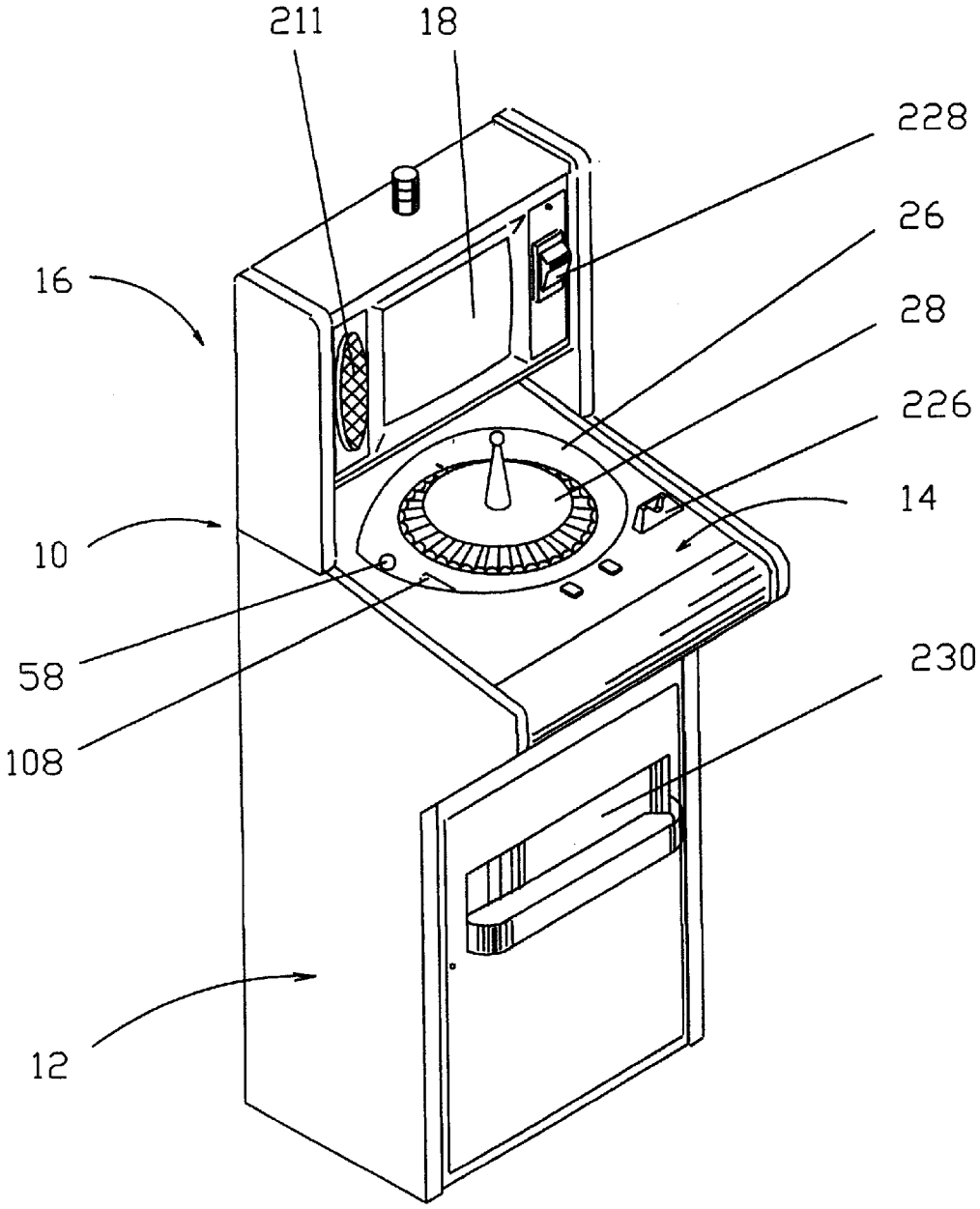
FIG. 1 is a general three-dimensional view illustrating the appearance of the entire machine.

FIGS. 1 through 7—Detailed Description of the Embodiment of the Apparatus of the Invention with the Ball Transfer Mechanism A general three-dimensional view illustrating the appearance of the entire machine is shown in FIG. 1. It can be seen that in general the apparatus consists of a housing 10 which has a base 12, a playing table 14 supported by base 12, and a vertical stand 16 that supports a display 18. In FIG. 1 the apparatus is shown as it is viewed from the player's side. On this side base 12 has in its upper portion a bill validator 228 and a coin dispenser 230. Playing table 14 has a coin acceptor 226 and a transparent convex cover 26, e.g., of a semispherical shape, that prevents access to a roulette wheel 28 rotatingly installed in the apparatus and driven by a motor (not shown in FIG. 1). Reference numeral 211 designates a speaker installed on a sides of display 18 and supported by vertical stand 16.

The aforementioned main units of the apparatus will be further described separately in detail along with associated auxiliary mechanisms.

Since the heart of the apparatus is the ball drive and feeding mechanism and the wheel drive mechanism, they will be considered first.

Figure 2A:
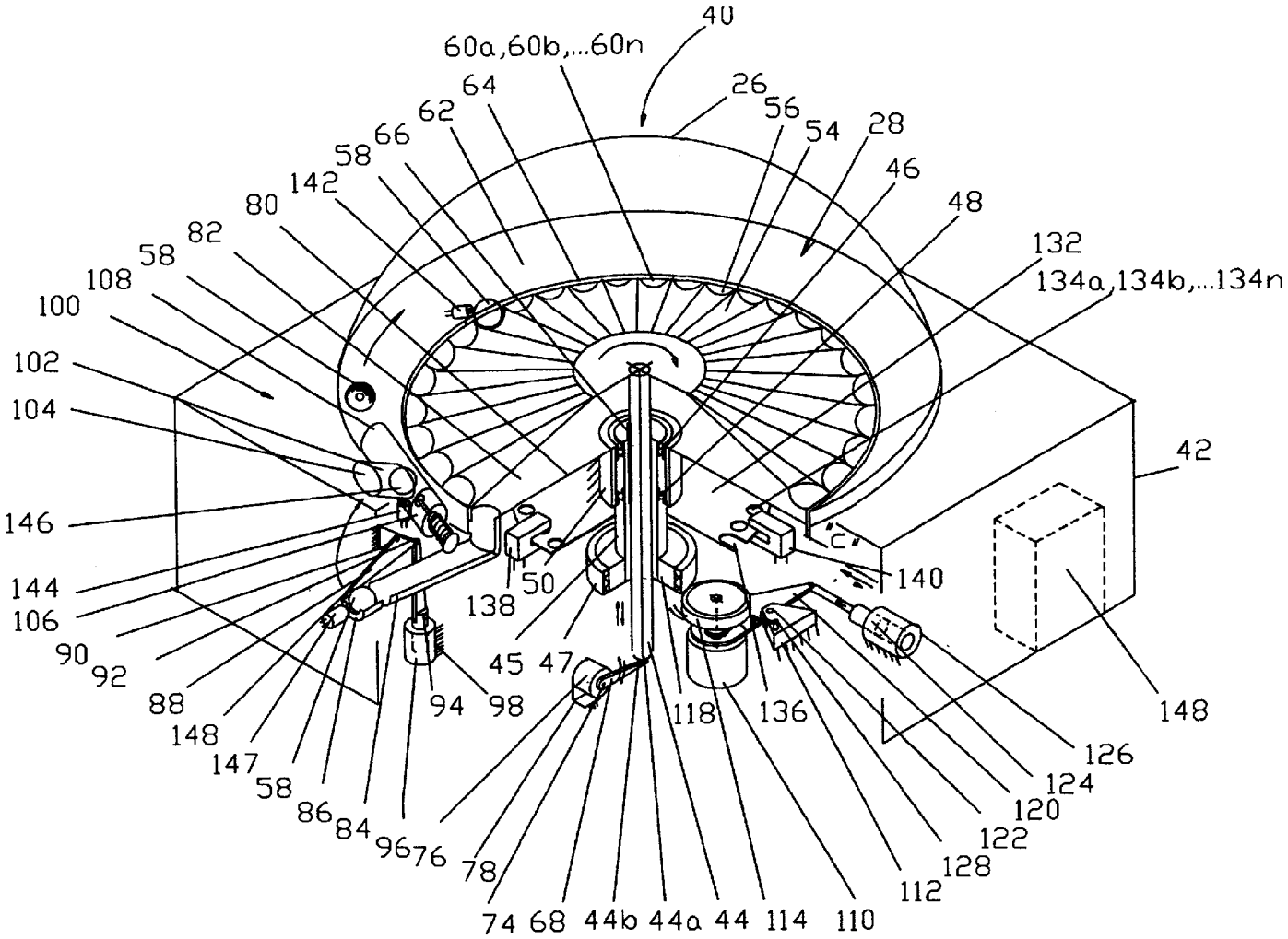
FIG. 2A is a three-dimensional partially sectional view of the mechanical part of the machine of FIG. 1 illustrating the roulette wheel and ball drive and feeding mechanisms.

FIG. 2A—Description of the Wheel Drive Mechanism and the Ball Drive and Feeding Mechanism FIG. 2A is a three-dimensional sectional view of the mechanical part of the machine of FIG. 1 illustrating the roulette wheel drive mechanism, as well as the ball drive and feeding mechanism. These mechanisms are designated in general by reference numeral 40 and hereinafter will be referred to as an "electromechanical roulette playing unit". As can be seen from FIG. 2A, electromechanical roulette playing unit 40 is placed in a housing 42 which, in turn, is placed and fixed in a playing table 14, e.g., by screws (not shown).

Housing 42 rotatingly supports a shaft 44 in ball bearing supports 46 and 48 which are secured in a stationary part 50 of housing 42. Rigidly fixed to the upper end of shaft 44 is aforementioned roulette wheel 28 which has an upper surface 54 tapering downwardsly from the center of the wheel towards a wheel periphery 56 so that if a ball 58 falls onto upper surface 54, it will roll down in the radial outward direction towards periphery 56. Although only one ball 58 participates in the game, several balls are shown in FIG. 2A in order to illustrate different operating positions of the ball during the game. Periphery 56 has a plurality of circumferentially spaced recesses 60*a*, 60*b* . . . 60*n* formed on its very edge. In other words, there are "n" recesses on the periphery of roulette wheel 28. Each recess has a concave spherical surface capable of holding ball 58 when the latter looses its momentum. Each recess has a specific numerical bet value (not shown) that may be marked on surface 54 adjacent to the respective recess.

Since recesses 60*a*, 60*b*, . . . 60*n* are formed on the very edge of roulette wheel 28, in order to protect ball 58 from falling down from the wheel during the playing cycle of the game, housing 42 has on it upper side a funnel like surface 62 that tapers radially downwards towards periphery 56 of roulette wheel 28. The inner edge 64 of funnel surface 62 is spaced from wheel periphery 56 at a distance "C" which is smaller than the diameter of ball 58. The ball is in a constant contact with the facing edge of funnel surface 62 so that when roulette wheel 28 is lifted, ball 58 falls down onto the inclined trough which is described later. When the ball is caught by a recess of roulette wheel 28 and the wheel rotates with a low speed, the friction force that holds the ball in the recess exceeds the friction force between the ball and the aforementioned edge of funnel surface 62 so that the ball remains within the respective recess.

The portion of wheel shaft 44 that is supported in bearing supports 46, 48 has a sliding key 66 that allows shaft 44 together with roulette wheel 28 to slide up and down in the vertical direction with respect to a sleeve 45 which supports at its lower end a driven friction wheel 47 the purpose of which will be explained later. It is understood that sleeve 45 and driven friction wheel 47 rotate together with shaft 44 but do not slide in the axial direction of the shaft. The lower end 44*a* of shaft 44 rests on an arm 68 via a thrust member such as a ball 44*b*. Arm 68 is connected to a core of a rotary solenoid 76. The latter is rigidly fixed to a stationary part 78 of housing 42. Thus, activation of solenoid 76 will rotate a core 74 of this solenoid in a counterclockwise direction, and will raise shaft 44 together with roulette 28 upward. As a result, the aforementioned distance "C" between wheel periphery 56 and inner edge 64 of the funnel surface 62 becomes greater than the diameter of ball 58 so that ball 88 falls onto an inclined trough located beneath roulette wheel 28. A portion 82 of trough 80 has a width slightly greater than the diameter of roulette wheel 28 and a portion 84 has a tubular shape with the diameter of the tube slightly greater than the diameter of ball 58. The lowermost end of inclined tubular portion 84 of the trough adjoins a ball-receiving basket 86. This basket is supported by an arm 88 of a bifurcated lever 90. Other arm 92 of lever 90 is pivotally connected to a core 94 of a solenoid 96. The latter is rigidly attached to a stationary part 98 of housing 42.

Activation of solenoid 96 and rotation of bifurcated lever 90 associated with the activation of solenoid 96 raises ball-receiving basket 86 to the level of and in alignment with a ball-launching station 100. This station consists of a tubular portion 102 which has a side window 104. When ball-receiving basket is raised to its upward position shown by dotted lines in FIG. 2, it is aligned with window 104. Since the basket is slightly inclined downwards, ball 58 will roll down through window 104 to tubular portion 102. The latter is slightly inclined downwards outwardly. Ball-launching station 100 has an electromagnetic launcher 106 that adjoins the outward end of tubular portion 102 so that ball 58 may roll down into ball launcher 106. This launcher is capable of launching the ball towardss roulette wheel by striking the ball with the solenoid core.

Lever 90 lies in a plane perpendicular to the ball-launching trajectory, so that the rotation of lever 90 will not interfere with the parts of a ball-launching station 100 and will deliver ball 58 directly into side window 104 of tubular portion 102 of ball-launching station 100.

As is shown in FIG. 1, the outlet end 108 of tubular portion 102 (FIG. 2A) is arranged tangentially to the circumferential periphery 56 and is inclined upward so that ball 58 is launched slightly upward and tangentially to roulette wheel 28.

As has been mentioned earlier, the playing portion of wheel 28 is covered by transparent semispherical cover 26 (FIGS. 1 and 2A).

Shaft 44 with roulette wheel 28 is driven into rotation by means of an electric motor 110 which is attached to a stationary part 112 of housing 42 and transmits the rotation from a drive friction wheel 114 on the shaft of motor 110 to a driven friction wheel 47. Drive friction wheel 114 together with motor 110 is supported by a lever 120. Drive friction wheel 114 is constantly pulled in a direction away from driven friction wheel 47 by a spring 128, so that when clutch solenoid 126 is energized, its core is shifted forward and pushes lever 120 forward against the force of return spring 128.

When clutch solenoid 126 is energized, its core is shifted forward and brings drive friction wheel 114 into contact with driven friction wheel 47 so that sleeve 45 begins to rotate and transmits the rotation via sliding key 66 to shaft 44 and hence to roulette wheel 28.

Figure 2B:
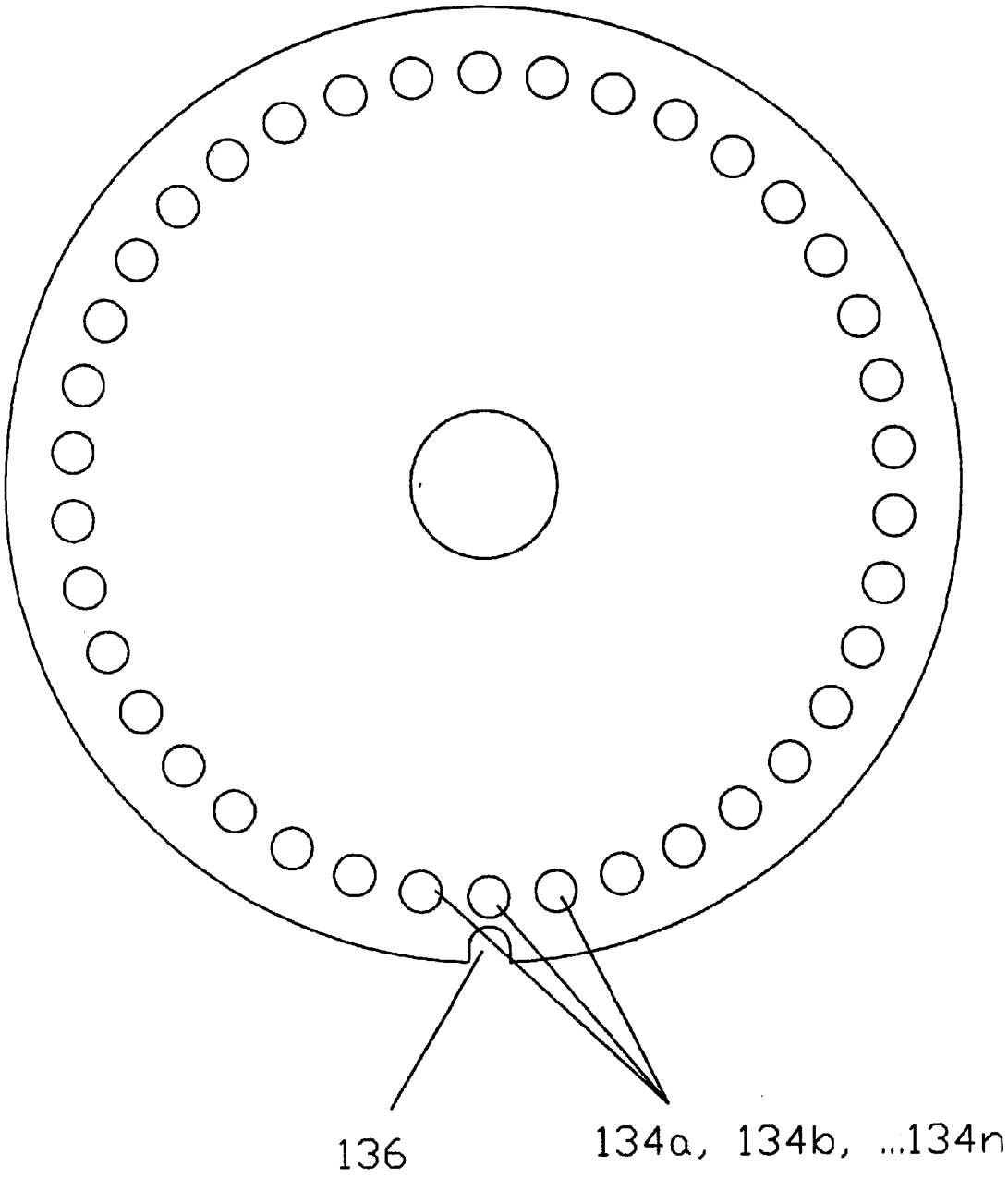
FIG. 2B is a top view of an indexing wheel.
Figure 2C:
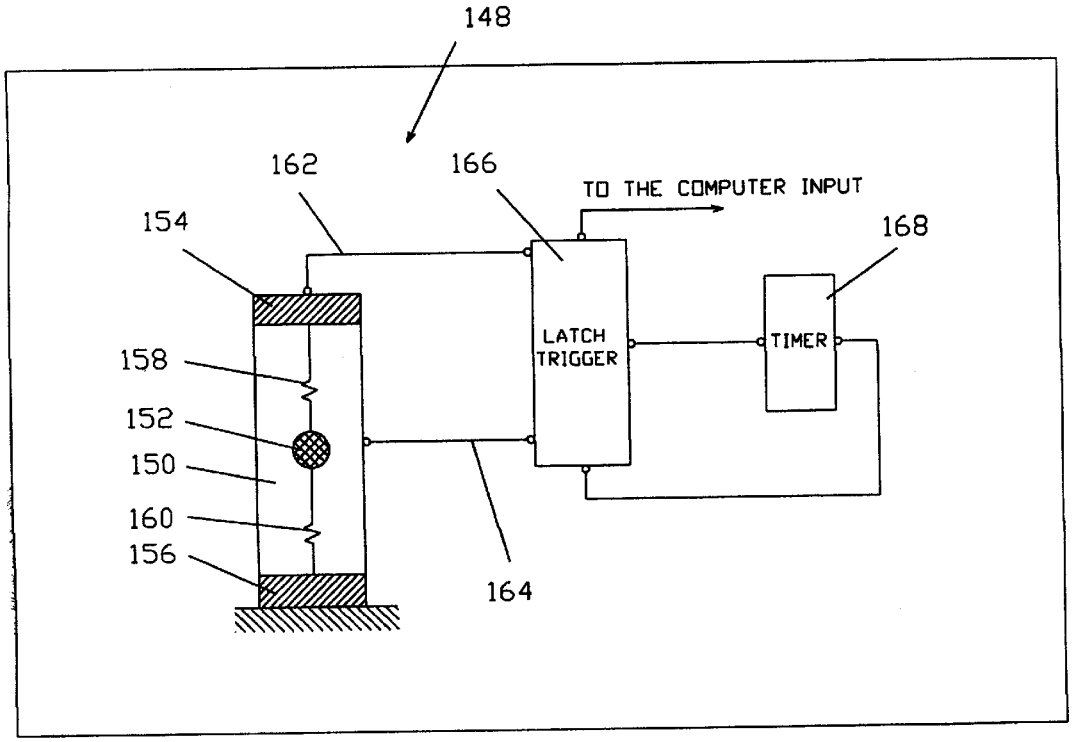
FIG. 2C is a schematic view of an anti-shock mechanism.

The upper end of sleeve 45 supports an indexing wheel 132 which has a row of positioning holes 134*a*, 134*b* . . . 134*n* uniformly spaced in a circumferential direction. This is shown in FIG. 2B which is a top view of an indexing wheel. Indexing wheel 132 has a single indexing hole 136. Angular positions of positioning holes 134*a*, 134*b*, . . . 134*n* on indexing wheel 132 correspond to the angular positions of respective recesses 60*a*, 60*b*, . . . 60*n*. Angular positions of each positioning hole with respect to indexing hole 136 are known.

Angular positions of each positioning hole (134*a*, 134*b*, . . . 134*n*) are determined by an optoelectronic sensor 138. Another optoelectronic sensor 140 detects angular positions of indexing hole 136.

A reflective optoelectronic sensor 142 is installed at the inner edge of funnel 62 so that it can detect ball 58 which is caught by any recess and rotates together with the roulette wheel 28. The actual position of the recess which holds the ball is determined by means of an electronic system which includes sensors 138, 140, 142 and a central processing unit, as will be described later with reference to FIG. 3.

The aforementioned electronic system also contains three more sensors, i.e., an optoelectronic sensor 144 which is located below a hole 146 in tubular portion 102 of ball launching station 100 for detecting that ball 58 is in the ball launching position. Similarly, an optoelectronic sensor 147 is installed below an opening 148 of basket 86 for detecting that ball 58 fell into basket 86.

One distinguishing feature of the roulette playing apparatus of the invention is that it is equipped with a mechanism which can cancel the game if apparatus housing 42 is accidentally or intentionally shaken during movement of the ball, so this would change the result of the game, even if the shaking is caused by the jolt of an earthquake. This is especially important for the machine of the present invention which is intended for an individual player so that the roulette game may not be observed by other people.

In FIG. 2A this anti-shocking mechanism is shown in general as a box 148. This mechanism will now be described in more detail with reference to FIG. 2C which is a schematic view of an anti-shock mechanism. The mechanism consists of a cylindrical housing 150 which is made of an electroconductive material and rigidly atatched to housing 42 of the machine via electrical insulating pads 154 and 156. Cylindrical housing 150 contains a ball 152 which is suspended inside housing 150 by springs 158 and 160. At least spring 158 must be electroconductive. Normally ball 152, which also is made of an electroconductive material, is kept out of contact with the walls of cylindrical housing 150 and is spaced from this walls with a small gap. Even a slightest shake of housing 42 will cause oscilaltions of ball 152 within housing 150 so that ball 152 will come into electrical contact with the wall of electroconductive housing 150. Ball 152 and housing 150 are electrically connected by conductors 162 and 164 to inputs of an electronic latch 166. One output of latch 166 is connected to a timer 168 and another output of the latch is connected to the computer input/otput board which will be described later in connection with FIG. 3.

Figure 3:
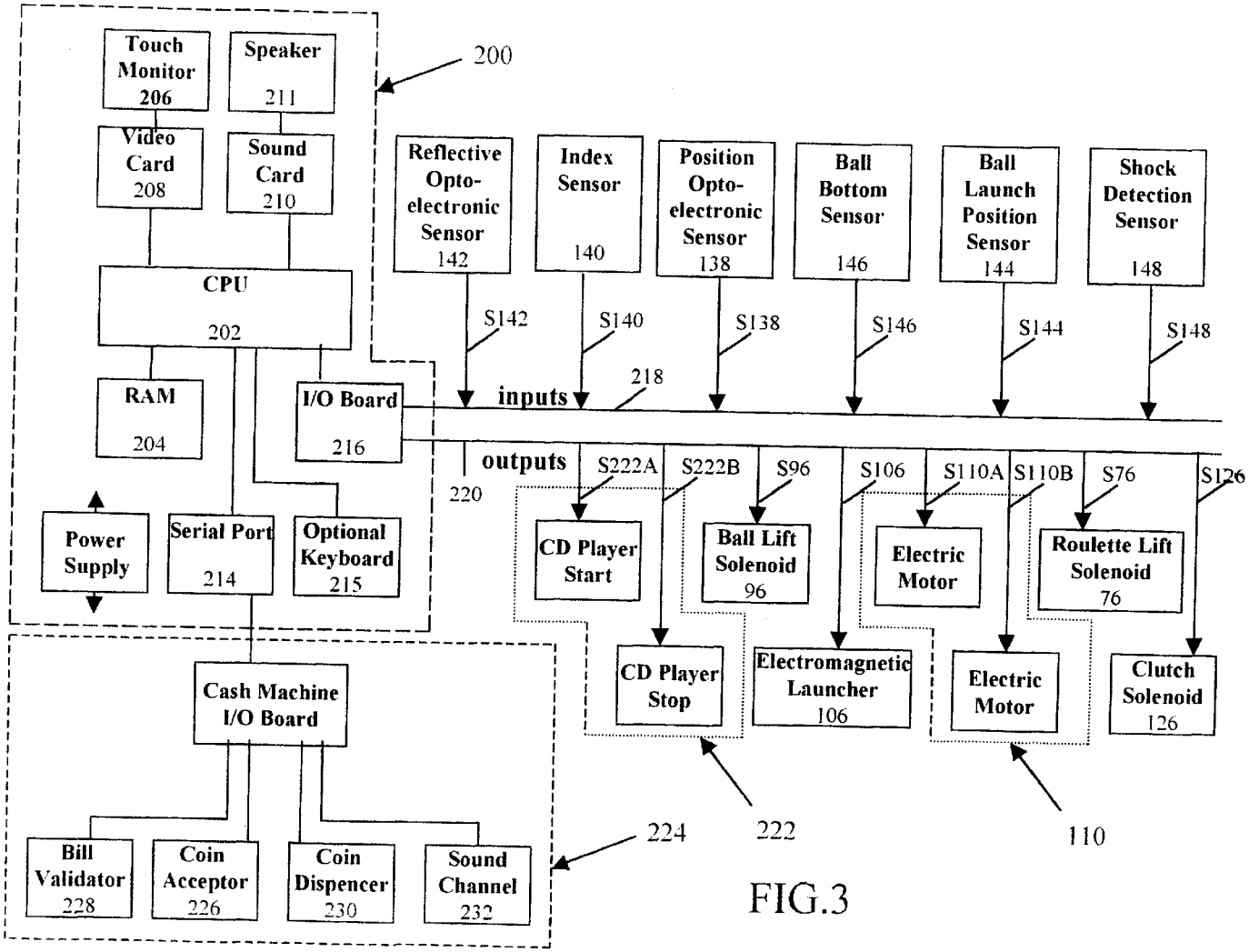
FIG. 3 is an electric system of the machine partially shown in a block-diagram form.
Figure 4A:
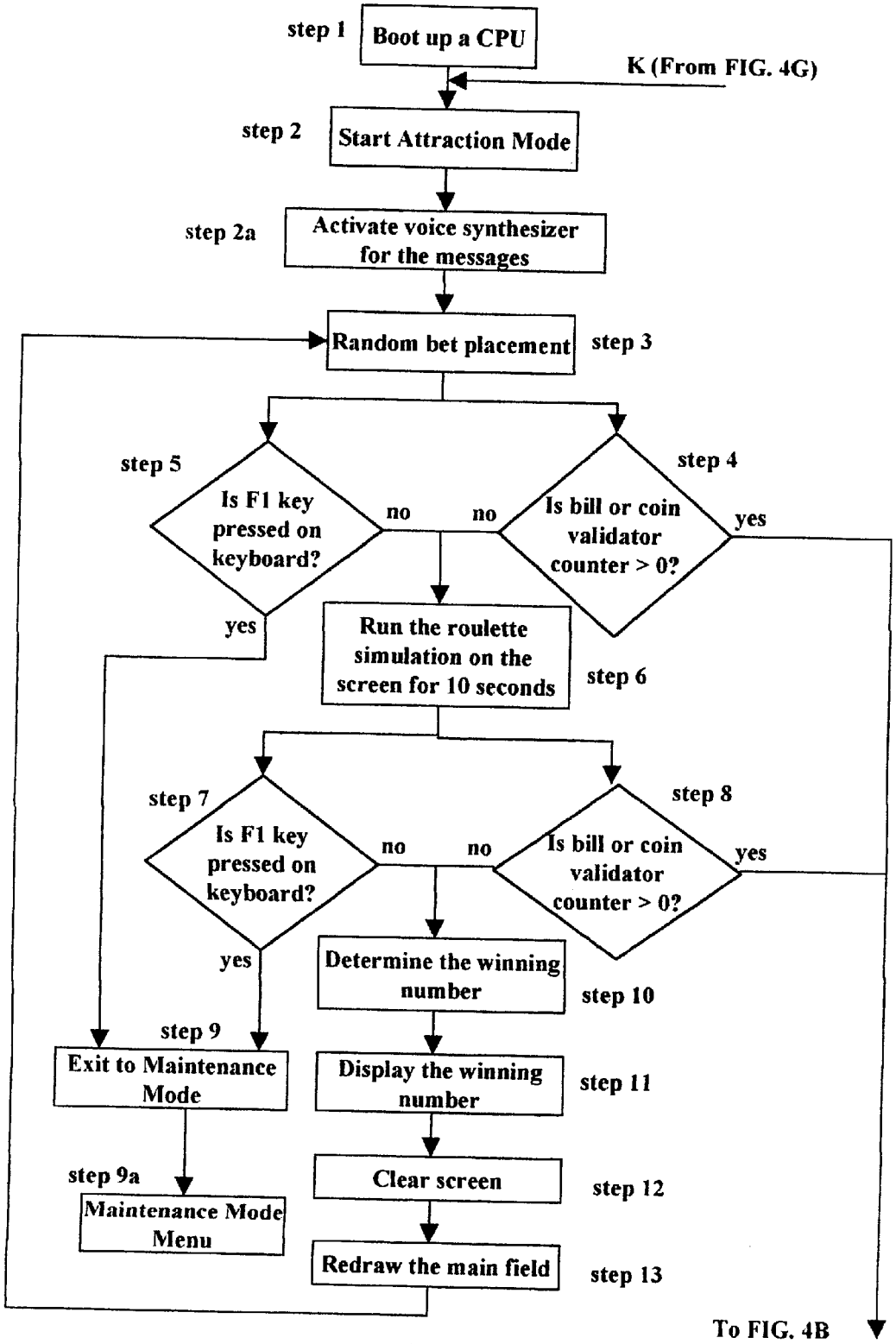
FIGS. 4A–4G show a flowchart that illustrates the sequence of operation of units and mechanisms of the machine.
Figure 4B:
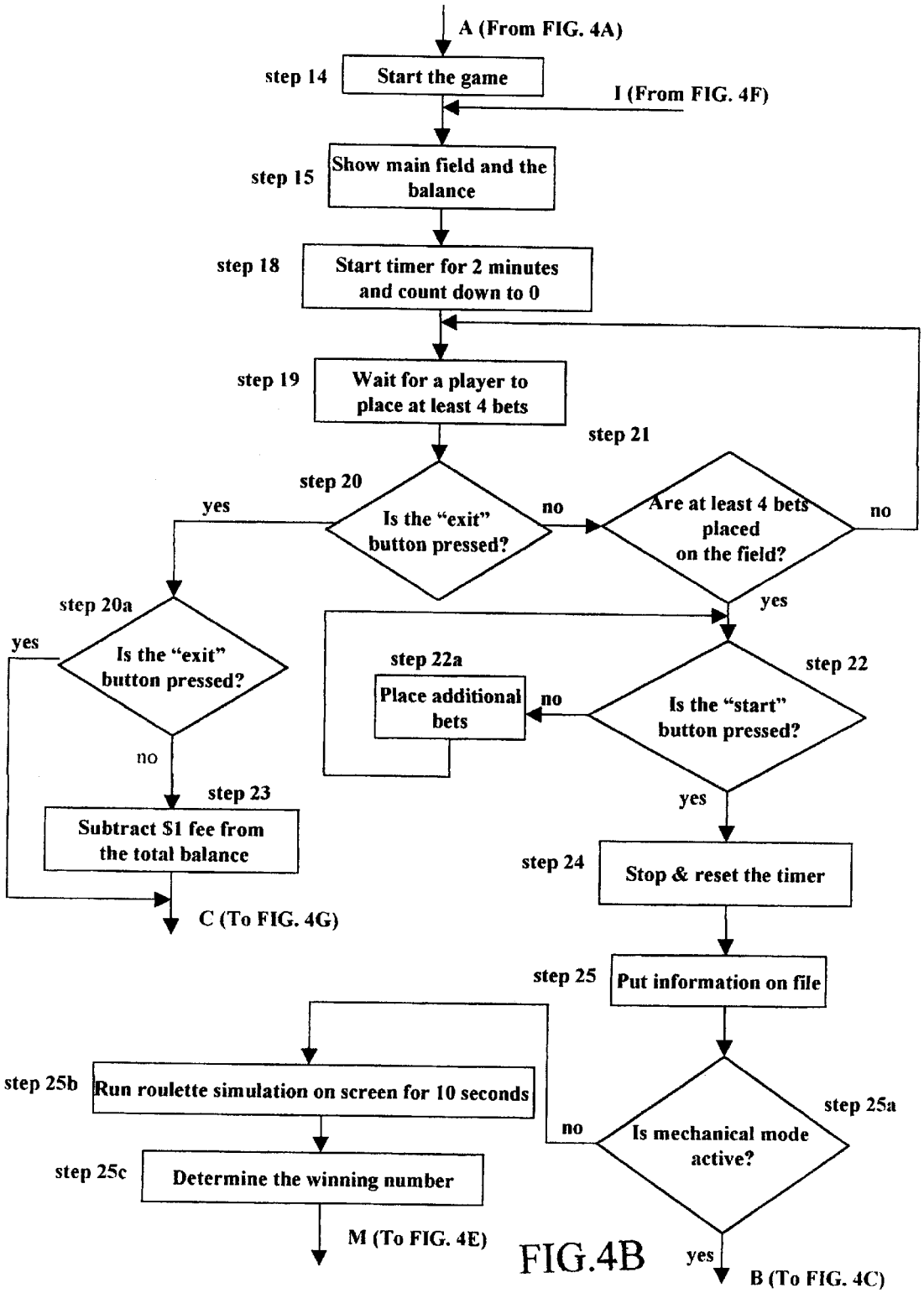
Figure 4C:
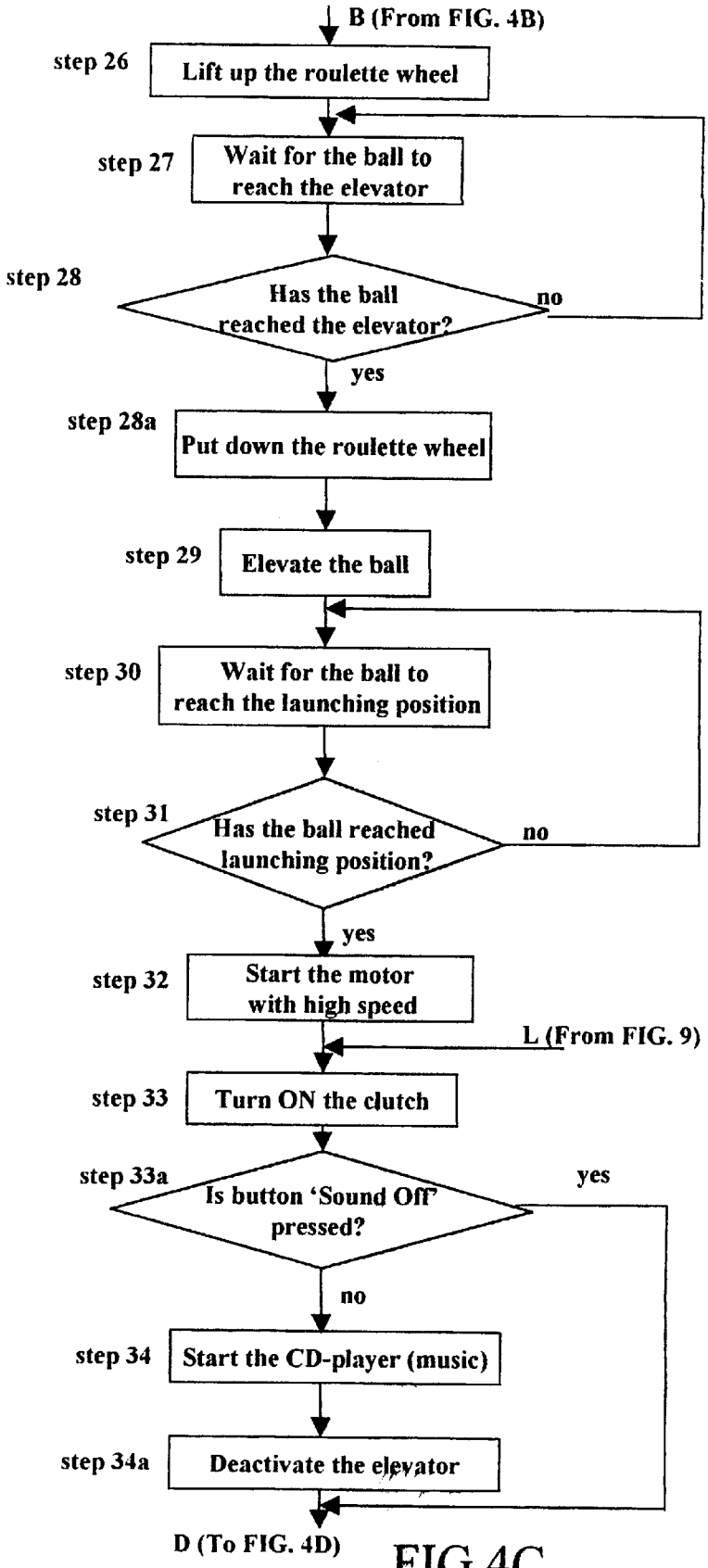
Figure 4D:
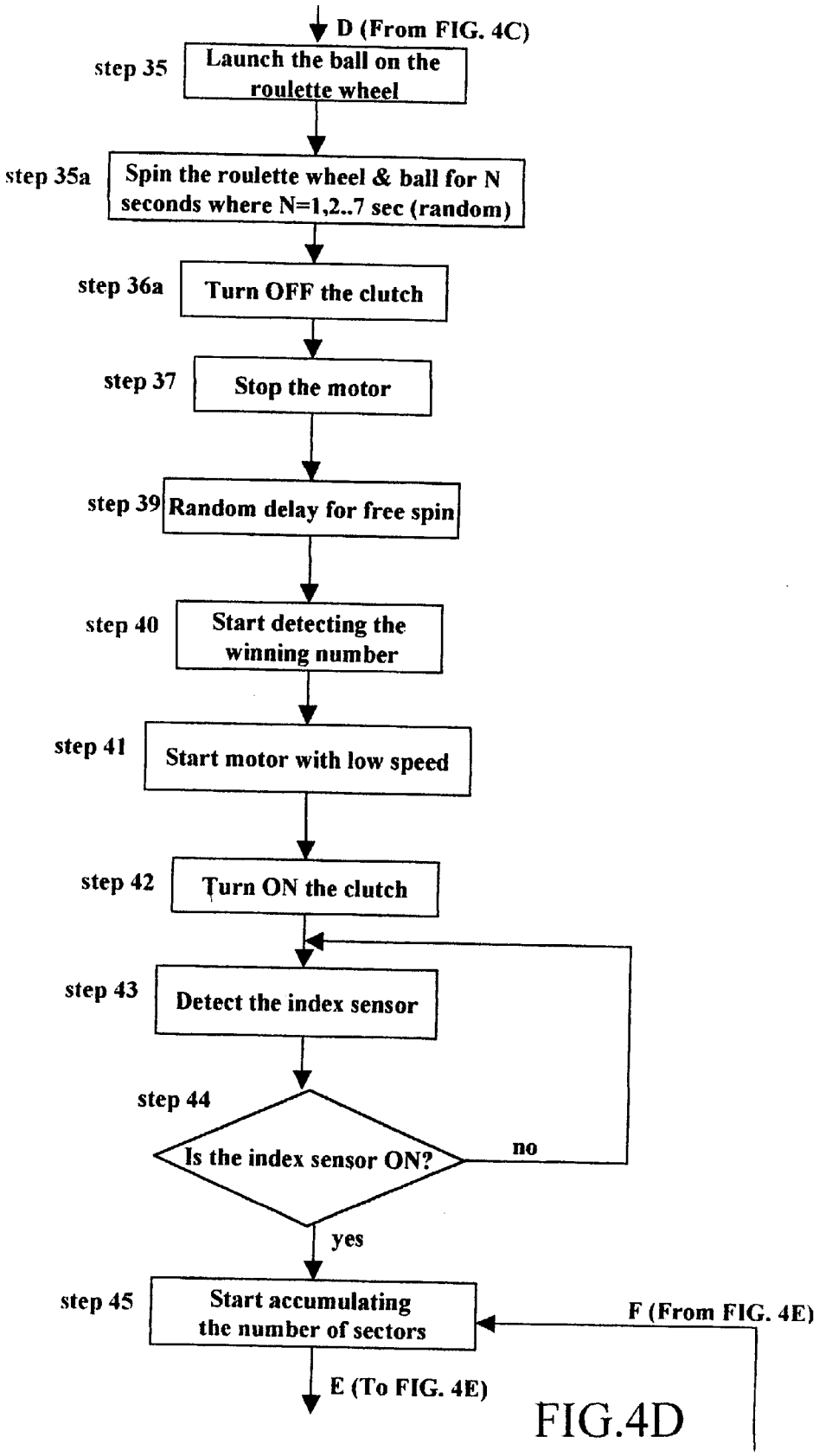
Figure 4E:
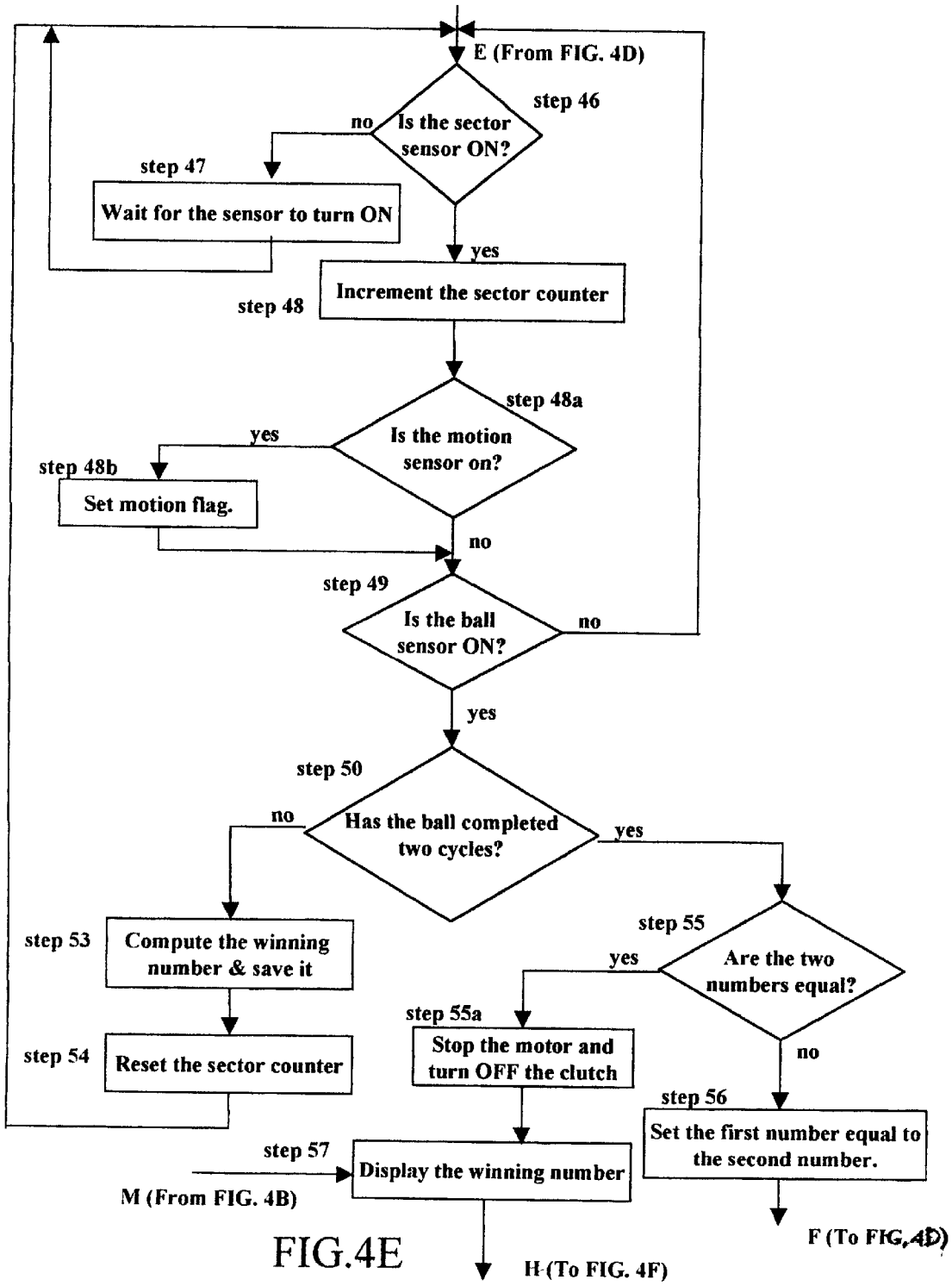
Figure 4F:
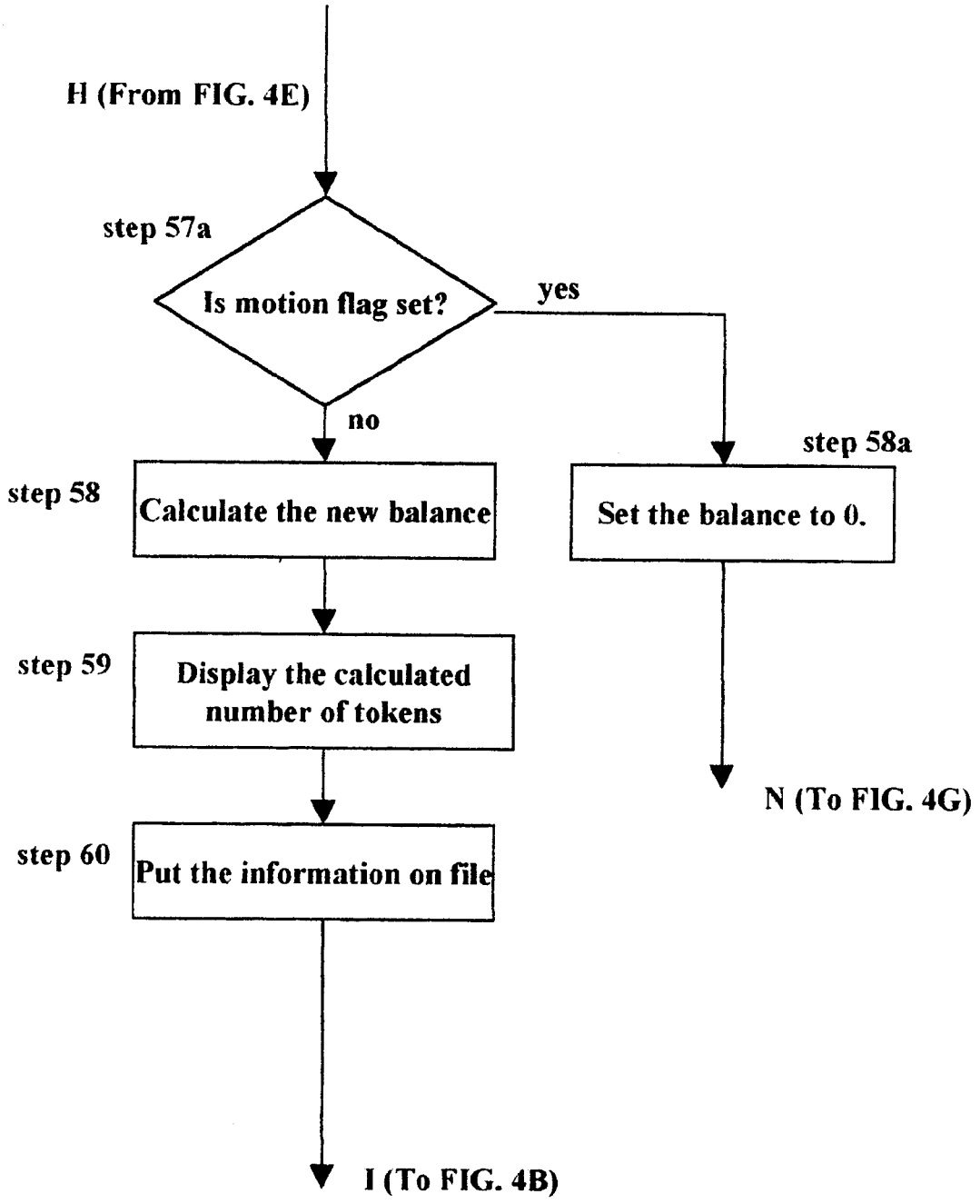
Figure 4G:
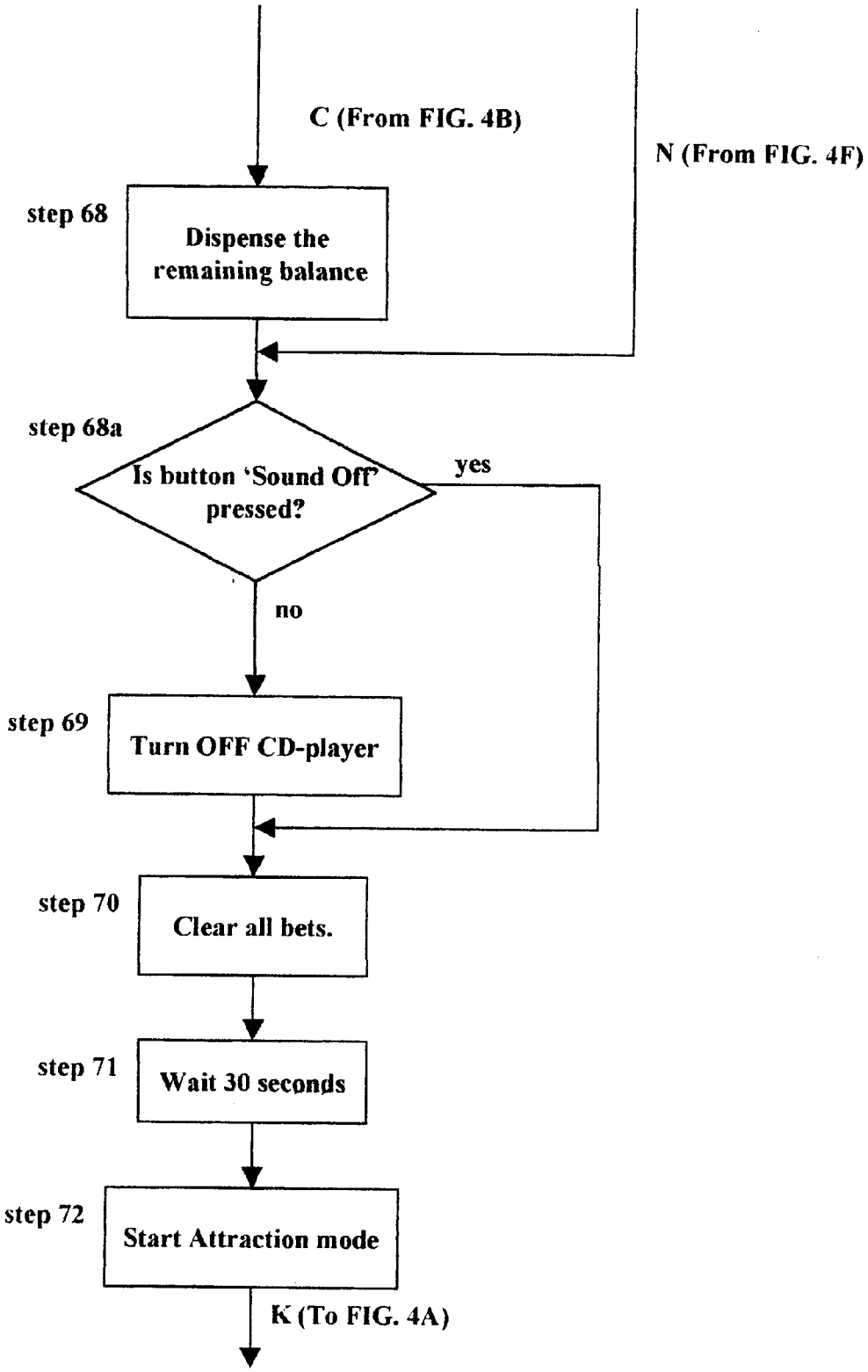

FIG. 3—Electric System of the Machine

FIG. 3 is an electric system of the machine partially shown in a block-diagram form. As shown in this drawing, the electric system of the machine contains a computer 200 which may be a conventional personal computer with its standard components such as a central processing unit (CPU) 202 connected to which are a random access memory (RAM) 204, a touch-screen monitor 206 connected to CPU 202 via a video card 208, a sound card 210 connected to a speaker 211, a serial interface 214, an optional keyboard 215 which is inaccessible to a player (i.e., located, e.g., inside a closed compartment of the machine) and intended for use by a maintenance man for servicing the machine, and an input/output (I/O) board 216. The computer contains other standard components which are not shown as they are not needed for the description of the machine operation. I/O board 216 has several inputs and outputs. The following input signals are coming from the respective sensors: $S_{142}$from reflective optoelectronic sensor 142; $S_{140}$ from indexing optoelectronic sensor 140; $S_{138}$ from position optoelectronic sensor 138; $S_{146}$ from ball bottom position sensor 146; $S_{144}$ from ball launching position sensor 144; and $S_{148}$ from shock detection sensor 148. The aforementioned sensors and their functions have been described earlier.

The following output signals are going to the respective units: Start $S_{222A}$ to a CD player 222 (which is a standard CD player unit that receives two signals from I/O board 216);

$S_{222B}$ to stop CD player 222; $S_{96}$ to ball lift solenoid 96; $S_{106}$ to electromagnetic launcher 106; $S_{110A}$ High-Speed Motor Signal to motor 110; $S_{110B}$ Low-Speed Motor Signal to motor 110; $S_{76}$ to a roulette wheel lift solenoid 76; $S_{126}$ to clutch solenoid 126.

Computer 200 is also connected to a cash in-out machine 224 which consists of the following standard units: a coin acceptor 226 which receives coins from the player (Condor Coin Acceptor, Model CN101, the product of Coin Control International, Nevada, USA); a bill validator 228 which receives paper banknotes (Model DBV45/145, the product of JCM, Nevada, USA); a coin dispenser 230 (Model DH-750, the product of Asahi Seiko USA, Nevada, USA); which dispenses coins which correspond to the win sum; and an audio unit 232.

FIGS. 1–7—Operation of the Computerized Roulette Playing Apparatus

Figure 5:
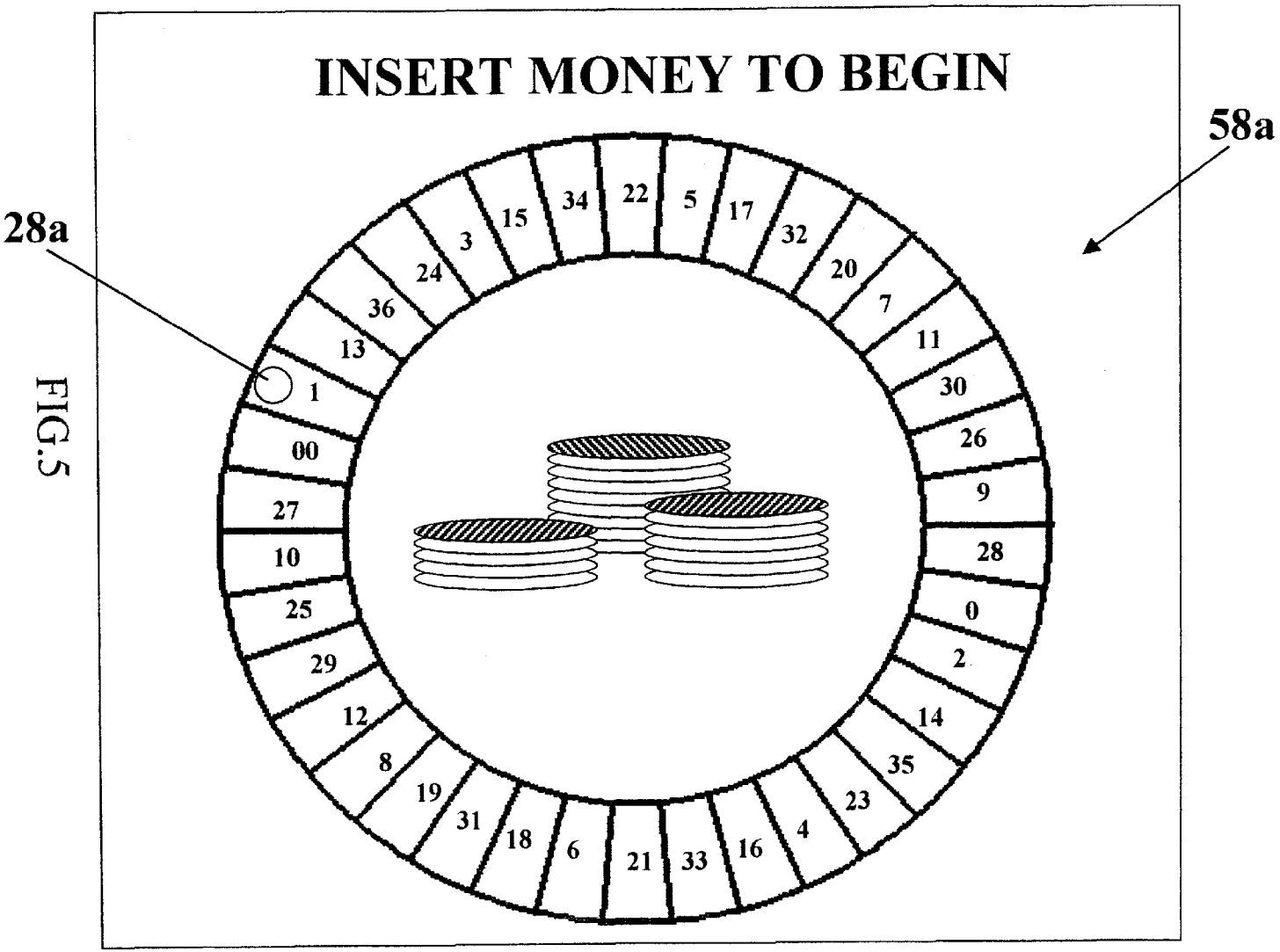
FIG. 5 is a view of a display of the apparatus illustrating one example of an attraction mode.
Figure 6:
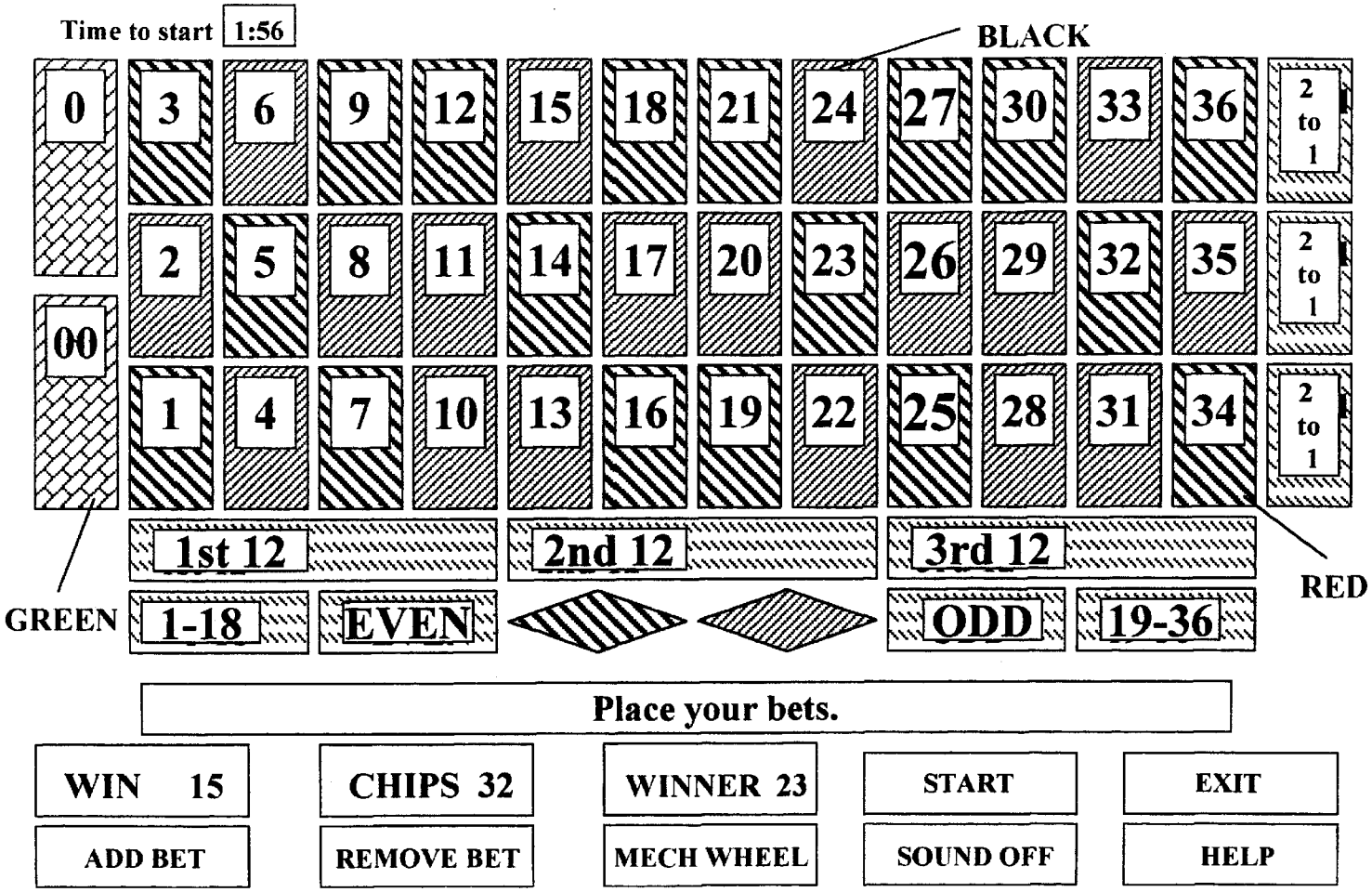
FIG. 6 is a view of a display of the apparatus in a game mode illustrating an example of a betting mark pattern.

The operation of the computerized roulette playing apparatus of the present invention will now be described with reference to aforementioned FIGS. 1, 2A, 2B, 2C, and 3 and with reference to additional drawings shown in FIGS. 4A–G (which is a flowchart that illustrates the sequence of operations of units and mechanisms of the machine), FIG. 5 (which is a view of a display of the apparatus illustrating one example of an attraction mode), FIG. 6 (which is a view of a display of the apparatus in a game mode illustrating an example of a betting mark pattern) and FIG. 7 (which is a view of a display of the apparatus in a maintenance mode).

The machine is started by booting up computer 200 (Step 1 in FIG. 4A–G) which shows on its touch-screen monitor 206 a picture that corresponds to so-called start attraction mode (Step 2). An example of a picture shown on monitor 206 in a start of the attraction mode is shown in FIG. 5. In this mode, the machine is playing by itself but without involvement of mechanical units. In other words, the play occurs only on the screen of monitor 206. As can be seen from FIG. 5, the screen shows an imaginary roulette wheel 28A with betting numbers 0, 2, 14, 35 . . . 9, 28 (if seen in a clockwise direction) arranged circumferentially over the periphery of the wheel. An imaginary ball 58A is moving in a circumferential direction, e.g., in a clockwise direction, along wheel 28A. The audible information such as game rules is reproduced by sound card 210 and speakers 211 (Step 2*a*). Shortly after the start of the attraction mode, computer 200 switches the machine to a random bet placement step (Step 3) by imitating bet placement in random. After each bet computer 200 checks if the counter (not shown) of bill validator 228 or coin acceptor 226 counts a number exceeding 0 (Step 4). At the same time, computer 200 checks if a functional key (not shown) is pressed on optional keyboard 215 (Step 5). When the answer for both conditions is NO, the machine runs imaginary roulette wheel 28A for a given period of time, e.g., 10 sec (Step 6) and then the conditions similar to those described in Steps 4 and 5 are repeated in Steps 7 and 8. If the answer for both conditions is NO, the machine sequentially runs Steps 10 through 13 (FIGS. 4A–G) and then returns to Step 3.

If the functional key on optional maintenance keyboard 215 is pressed (Step 5 or Step 8), the machine is switched over to Exit (Step 9) from the attraction mode to a maintenance mode (Step 9*a*). The maintenance mode is a conventional mode used by maintenance team for checking the condition of the machine, for repair, replacement of parts, troubleshooting, etc. An example of a screen shown on monitor 206 in the maintenance mode is shown in FIG. 7. In the illustrated example, the maintenance mode allows the maintenance personnel to check several operations shown in FIG. 7. It is understood that these operations are shown only as an example and that the number of operations and their nature may be different.

If the answer to conditions of steps 4 or 7 is YES, which means that a player has loaded a coin or a bill into the machine, and the game is started (Step 14). The machine then shows the main screen represented by FIG. 6 which illustrates a conventional roulette field 234. This field contains 38 betting places with betting numbers 0, 3, 6, 9, etc., arranged in three parallel horizontal rows. The numbers correspond to respective recesses 60*a*, 60, . . . 60*n*. As has been mentioned above, each recess has its own winning number.

In addition to standard elements, main roulette field 234 of the machine of the invention has functional keys and displays which are distinguishing features of the present invention. All the buttons are imaginary buttons which are activated by touch. More specifically, a display WIN (FIG. 6) shows the number of tokens won as a result of the game session. A display TOKENS shows the number of tokens left after each bet. A display WIN. NUM shows the real winning number that corresponds to the number of the recess on roulette wheel 28. An elongated horizontal display 236 is used for messages and instructions to help the player.

The remaining boxes in the lower two rows in FIG. 6 correspond to functional touch-screen buttons which are described below.

START button is used for starting the game by touching this button. EXIT button is used for exiting the game and getting the remaining unspent balance. ADD TOKEN button is used to add one or more tokens to a box in the main field which has been selected by touch. REMOVE TOKEN button is used for removing one or more tokens from a box in the main field which has been selected by touch. COMPUTER PLAY button is used for selecting a Video Roulette Mode or a Mechanical Roulette Mode. SOUND OFF button switches off the sound. HELP button is used to display an instruction screen.

After having described the meanings and functions of various buttons and displays, we can proceed with the description of the game with reference to the operations performed by various mechanical and electrical units of the machine.

Since the preferred embodiment of the invention is described with reference to the standard roulette game, it would be worth to remind some basic rules of this game, i.e., the initial betting should include at least four bets. Furthermore, the token has a certain value below which the game is forbidden. In other words, since the machine accepts quarters as the minimum value coins, the betting should be at least one dollar.

After the player loaded a coin or a banknote into coin acceptor 226 or bill validator 228, the machine shows amount of tokens (Step 15). The machine activates a timer (not shown) of computer 200 for several minutes to let the player place the bets (e.g., for 2 min) (Step 18). The player locates the bets by touching selected boxes on main roulette field 234 (Step 19) and then loading the token by touching ADD TOKEN button. The tokens may be placed not only into different boxes but also in the same box. If for some reason the selection does not satisfy the player, he/she may cancel the bet by touching the chosen box and then touching REMOVE TOKEN button.

After Step 19 the machine is checking at Step 20 whether the EXIT button is pressed or not. If the answer is YES (Step 23) and no game has been played (Step 20*a*), the machine subtract a fine (Step 23), e.g., $1.00 from the balance and dispenses the remaining balance. If the answer is NO, the machine checks in Step 21 whether at least four bets are placed in the field or not. If the answer is YES, the machine checks whether START button (FIG. 6) is pressed or not (Step 22).

If the answer is YES, the program stops and resets the computer timer (Step 24), the information is loaded on the file (Step 25). Before that the player has selected the mode of the game (Step 25*a*), and if the video mode is selected, the operations described in Steps from 25*b* to 60 are performed automatically. The program then returns to Step 15 which shows main field 234 and the remaining balance in TOKENS display of the main field.

If the mechanical mode, i.e., the answer in Step 25A is YES, solenoid 76 is energized by signal S76 (FIG. 3) and rotates core 74 so that lever arm 68 is turned in the counterclockwise direction (FIG. 2), and roulette wheel shaft 44 is raised due to contact of arm 68 with lower end 44*a* of the shaft (Steps 26, 27). Since shaft 44 is rigidly connected to roulette wheel 28, the latter is also raised and releases ball 58 for falling onto portion 82 of inclined trough 80. As a result, ball 58 rolls down along trough portion 82 and then to tubular potion 84 of the trough till it reaches basket 86.

When in Step 28 optoelectronic sensor 147 detects that ball 58 is in basket 86, it sends signal S146 to I/O board 216 of computer 200 (FIG. 3). In response to this signal, computer 200 deactivates solenoid 76 by resetting signal S76. As a result, roulette wheel 28 descends under gravity (Step 28*a*) to the position of FIG. 2 in which ball 58 cannot fall down into trough 80. The computer also sends signal S96 (FIG. 3) to solenoid 96 which is activated and pulls in its core so that lever 90 is turned in a clockwise direction, whereby ball 58 is lifted and transferred to ball launching station 100 (Steps 29, 30). When ball 58 reaches the launching position (Step 31), it is detected by optoelectronic sensor 144 which sends signal S144 to I/O board 216 of computer 200. The latter sends signal S110*a* to start motor 110 which begins to rotate with a high speed (about 5 to 10 rpm) (Step 32). Computer 200 sends signal S126 to clutch solenoid 126 so that the latter is activated in Step 33 and put drive friction wheel 130 into position of engagement with driven friction wheel 47. As a result, high-speed rotation of motor 110 is transmitted to driven wheel 47 and hence, via sliding key 66 to roulette wheel 28. If necessary, CD player 222 can be switched off in Step 34.

After sensor 144 detects that ball 58 is in launching station 100, it sends signal S144 to I/O board 216 of computer 200, and the latter deactivates solenoid 96 by resetting signal S96 (Step 34*a*). Electromagnetic launcher 106 launches ball 58 via outlet end 108 of tubular portion of the launcher in a tangential direction to rotating roulette wheel 28 (FIG. 1) (Step 35). Ball 58 falls onto upper surface 54 of roulette wheel 28. Roulette wheel 28 rotates together with ball 58 for a period of time randomly selected by computer 200 so as to prevent cheating. The randomly selected period may vary, e.g., from 2 to 7 sec (Step 35*a*). Upon expiration of the selected period of time, computer 200 deactivates clutch solenoid 126 by resetting signal S126 (Step 36*a*). As a result, spring 128 will turn lever 120 in clockwise direction and disengage driven wheel 47 from drive friction wheel 130. Reset of signal S110*a* will switch off motor 110 (Step 37) Meanwhile roulette wheel 28 continues rotation by inertia with gradual decrease in speed. After certain period of time (Step 39), the machine starts detecting the winning number (Step 40) by starting motor 110 at low speed (signal S110*b*).

Computer 200 sends signal S126 to clutch solenoid 126 so that the latter is activated in Step 42 and put drive friction wheel 130 into position of engagement with driven friction wheel 47. As a result, roulette wheel 28 begins to rotate with low speed. When roulette wheel 28 rotates with low speed, sensor 142 checks whether or not ball 58 is in the same recess 60*a*, 60*b*, . . . or 60*n* for two complete rotations. If the ball is detected twice in the same recess, this means that the ball is caught by one of the recesses and rotates together with roulette wheel 28 while being kept in the aforementioned recess. This means that this recess is associated with the winning number and has to be determined.

The winning number is determined by means of sensors 138, 140, and 142. As has been mentioned above, angular positions of positioning holes 134*a*, 134*b*, . . . 134*n* on indexing wheel 132 (FIG. 2) correspond to the angular positions of respective recesses 60*a*, 60*b*, . . . 60*n*. Angular positions of each positioning hole with respect to indexing hole 136 are known. Angular positions of each positioning hole (134*a*, 134*b*, . . . 134*n*) are determined by an optoelectronic sensor 138. Another optoelectronic sensor 140 detects angular positions of indexing hole 136.

As roulette wheel 28 rotates with a constant low speed, sensor 140 detects positions of indexing hole 136 (Step 43) Once it is found (Step 44), computer 200 starts accumulating the number of recesses by calculating the number of positioning holes (134*a*, 134*b*, . . . 134*n*) (Step 45). This process continues until sensor 142 detects ball 58 in Step 49. If in Step 49 the answer is YES, Steps from 43 to 49 are repeated for verification. If the verification produces the same result twice, the winning number is detected in Step 53 based on the readings of aforementioned sensors. Then the machine automatically displays the winning number (Step 57), calculates the new balance according to the game rules (Step 58), displays the calculated number of tokens (Step 59), puts the information on the file (Step 60), and computer 200 sends command to switch off clutch 126, in the same manner as has been described above, and stops motor 100 by resetting signal S110*b* (Step 61). Thus the complete cycle of the game is over, and the program checks signal S148 from anti-shock mechanism 148. If during spinning of roulette wheel 28 the wheel was intentionally shaken to the extent that ball 152 (FIG. 2B) touched the surface of cylindrical conducive housing 150 so that a signal was generated by latch trigger 166 and sent to I/O board 216 of computer 200, the program will reset the remaining balance on TOKENS display (FIG. 6) to zero. Following this the program returns to Step 15. Now the player has a choice to start another cycle by placing the bets on main filed 234, or to finish the game by pressing the EXIT button on the main field.

The machine is then automatically prepared to return to the attraction mode by completing Steps 69 to 72 and returning to Step 2.

If the EXIT button is pressed without anti-shock mechanism 148 having been shaken, the remaining balance is dispensed (Step 68), and the machine is then automatically prepared to return to the attraction mode by completing Steps 69 to 72 and returning to Step 2.

Figure 8:
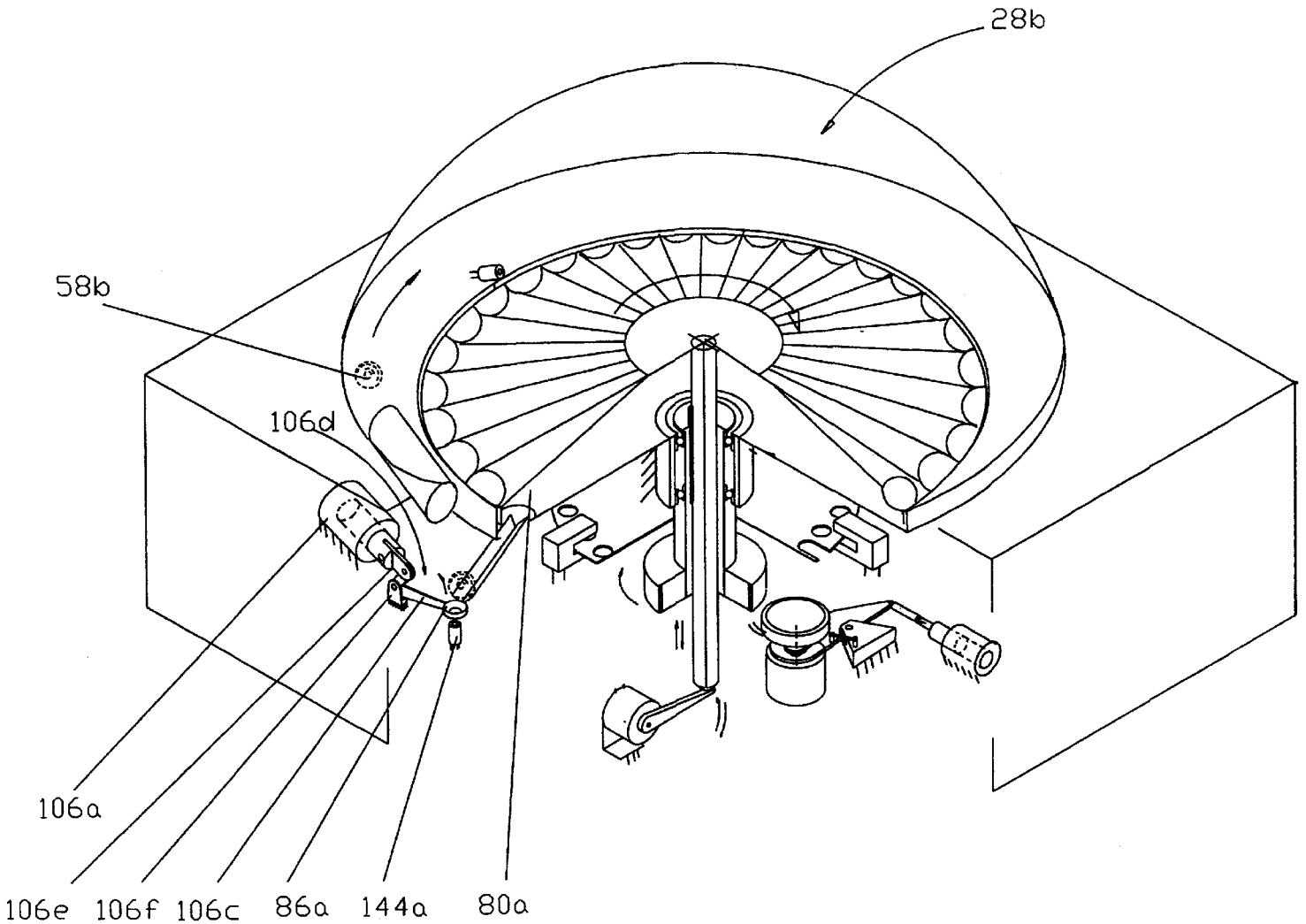
FIG. 8 is a three-dimensional partially sectional view of the apparatus according to an embodiment with a mechanism for transfer of the ball from the guide trough to the ball launching station.
Figure 9:
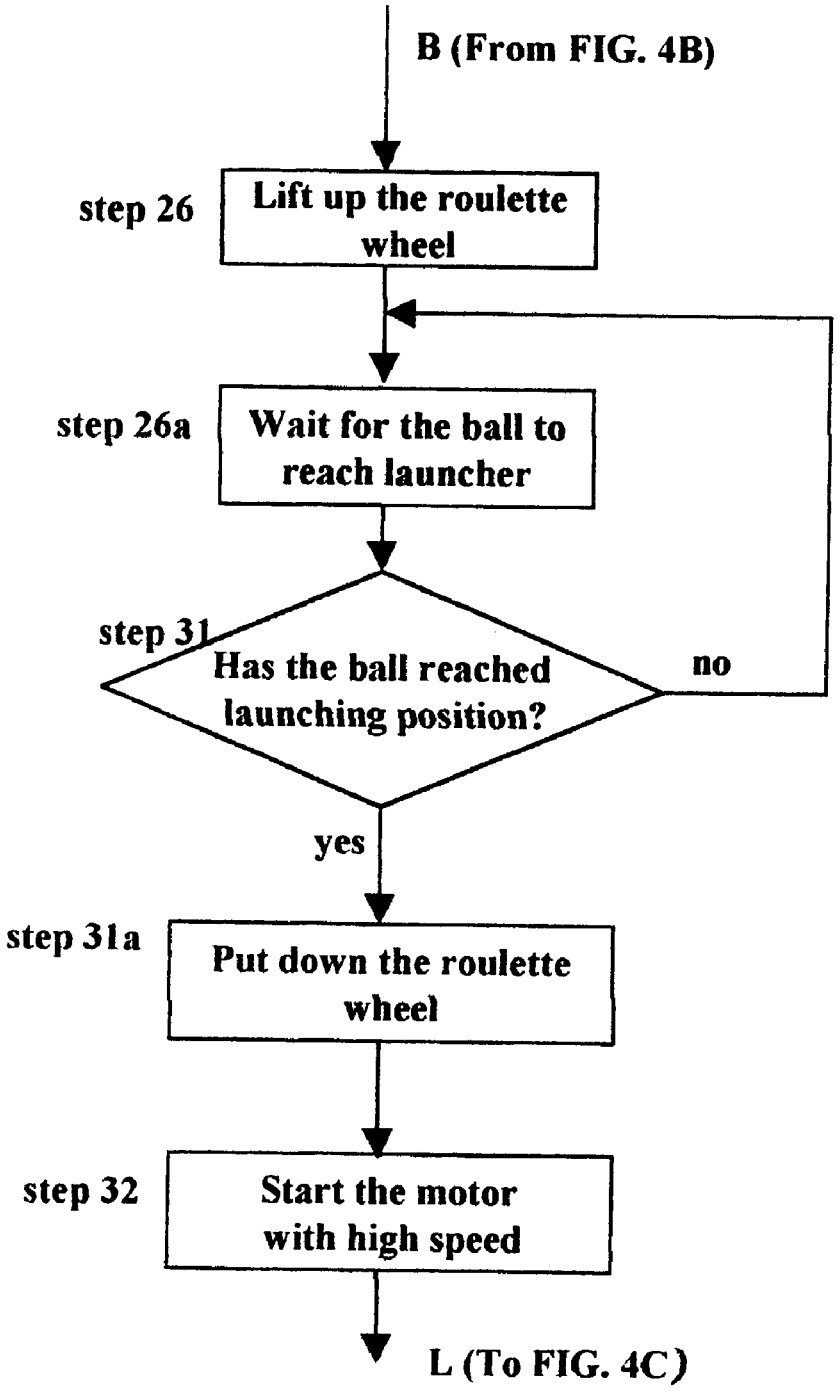
FIG. 9 is a portion of the flowchart associated with the operation of the ball transfer mechanism of FIG. 8.

FIGS. 8 and 9—Detailed Description of the Embodiment of the Apparatus of the Invention without the Ball Transfer Mechanism The embodiment of FIGS. 8 and 9 is a simplified version of the apparatus described with reference to FIGS. 1 through 7 and differs from it in that ball 58*b* is launched to roulette wheel 28*b* directly from a ball receiving basket 86*a* into which ball 58*b* falls along inclined through 80*a*. Similar to launching station 100 of FIG. 2, the presence of the ball in launching station 100*a* is determined by an optoelectronic sensor 144*a*, and when the presence of ball is confirmed by a signal S144 (FIG. 3), it is launched from a basket 86*a* which is attached to one arm 106*c* of a bifurcated lever 106*d*, whereas the other end 106*e* is pivotally connected to the core of solenoid 106*a* via a link 106*f*. Solenoid 106*a* is rigidly fixed to the housing of the machine. The remaining part of the machine remains the same as in the previous embodiment since the ball is launched from basket 106*b* by lever 106*d* to outlet end 108 of the tubular portion of the launcher (FIG. 1).

The electric block diagram of the machine of this embodiment will be the same as FIG. 3, with the exception that the block which generates signal S146 (in the upper right side of the diagram of FIG. 3) is eliminated since there is no need for transferring the ball from the basket to the launcher.

Thus it has been shown that the invention provides a roulette playing apparatus which is simple in construction, inexpensive to manufacture, is designed for participation of an individual player, allows to play in a limited space, excludes a human factor in launching a ball, allows to cover several bet marks with a single token, discontinues the game immediately upon accidental or intentionally shaking of the apparatus during movement of the ball, does not need the use of air under pressure for releasing the balls and feeding it to the hitting device, and allows free rotation of the roulette wheel independent of the drive motor thus making unable a remote control of the rotation of the wheel by a fraudster. The invention also provides a new roulette game for a single player.

Although the invention has been shown in the form of specific embodiments, it is understood that these embodiments were given only as examples and that any changes and modifications are possible, provided they do not depart from the scope of the appended claims. For example, a launcher and all actuation devices are not necessarily based on the use of solenoids and may be constructed with hydraulic, pneumatic of spring-loaded mechanisms. The motor disconnecting clutch may be in the form of an electromagnetic clutch, tooth clutch, etc. The number of sensors and their type may vary, and different principle may be used for detecting the winning number. For example, the position of the ball in the recess may be detected by a video camera.

What is claimed is:

1. A computerized roulette playing apparatus for a single player comprising:

a housing that contains a two-speed drive means, a shaft rotatingly supported in said housing and driven into rotation by said two-speed drive means, and a controllable clutch means between said shaft and said two-speed drive means;

a roulette wheel rigidly connected to said shaft and located outside of said housing, said roulette wheel having a plurality of recesses formed on the peripheral edge of said roulette wheel;

a transparent cover over said roulette wheel which prevents access of a player to said roulette wheel and which allows the player to see said roulette wheel;

a ball launching station within said housing with means for launching said ball to said roulette wheel;

a single ball for playing the game which is suitable for launching from said ball launching station to said roulette wheel;

ball guiding means for guiding said ball under gravity from any of said recesses to said ball launching station;

means for raising said shaft together with said roulette wheel to a position in which said ball falls down from any of said recesses onto said ball guiding means;

ball position detecting means comprising a first ball sensing means for detecting a position of said ball in any of said recesses, a second ball sensing means for detecting the presence of said ball in said launching station, and indexing means having marking means corresponding to said recesses, and third sensing means for detecting angular positions of said marking means;

a central processing unit for controlling operation of said two-speed drive means, said controllable clutch, said ball launching station, said first ball sensing means, said second ball sensing means, and said means for raising said shaft; and display means connected to said central processing unit, said display means displaying at least a main roulette game field patterned in accordance with the game rules, said pattern including at least betting places, a message display portion, a win number display place, a token number display place, a win token number display place, a game start place, and game exit place.

2. The roulette playing apparatus of claim 1, further comprising a shock detection means which is connected to said central processing unit for interrupting the game when a shock transmitted to said apparatus may change the results of the game.

3. The roulette playing apparatus of claim 1, wherein said cover has a convex shape oriented in the direction from said housing.

4. The roulette playing apparatus of claim 3, wherein said ball launching station comprises a first electromagnetic mechanism, an articulated mechanism pivotally connected to said first electromagnetic mechanism for swinging motions, and a ball receiving means connected to said articulated mechanism for launching said ball as a result of said swinging motion in response to detection of said ball with said second ball sensing means which confirm that said ball is in said launching station.

5. The roulette playing apparatus of claim 4, wherein said ball guiding means is a trough inclined downwards from said roulette wheel, and said clutch is a friction clutch which can disconnect said two-speed drive means from said shaft under a comma nd of said central processing unit.

6. The roulette playing apparatus of claim 5, wherein said indexing means comprise: an indexing wheel wherein said marking means comprise a plurality of positioning holes angular positions of which correspond to angular positions of said recesses on said roulette wheel; an indexing hole in said indexing wheel; third sensing means for detecting a starting position of said indexing wheel by means of said indexing hole; and fourth sensing means for detecting positions of said positioning holes, said third and said fourth sensing means being connected to said central processing unit.

7. The roulette playing apparatus of claim 6, wherein said means for raising said shaft comprises a second electromagnetic mechanism having a core and a first lever mechanism connected to said core, said electromagnetic mechanism being connected to said central processing unit, said shaft resting on said first lever mechanism and slidingly installed in said housing so that when said second electromagnetic mechanism is activated by a command from said central processing unit, said shaft is raised to a level from which said ball can drop onto said trough.

8. The roulette playing apparatus of claim 6, further comprising a shock detection means which is connected to said central processing unit for interrupting the game when a shock transmitted to said apparatus may change the results if the game.

9. The roulette playing apparatus of claim 2, wherein said ball launching station comprises a first electromagnetic mechanism, an articulated mechanism pivotally connected to said first electromagnetic mechanism for swinging motions, and a ball receiving means connected to said articulated mechanism for launching said ball as a result of said swinging motion in response to detection of said ball with said second ball sensing means which confirm that said ball is in said launching station.

10. The roulette playing apparatus of claim 9, wherein said ball guiding means is a trough inclined downwards from said roulette wheel.

11. The roulette playing apparatus of claim 10, wherein said indexing means comprise: an indexing wheel wherein said marking means comprise a plurality of positioning holes angular positions of which correspond to angular positions of said recesses on said roulette wheel; an indexing hole in said indexing wheel; third sensing means for detecting a starting position of said indexing wheel by means of said indexing hole; and fourth sensing means for detecting positions of said positioning holes, said third and said fourth sensing means being connected to said central processing unit.

12. The roulette playing apparatus of claim 1, further comprising means for receiving said ball from said trough, third sensing means for detecting the presence of said ball in said means for receiving said ball, and ball transfer means for transferring said ball to said ball launching station, said third sensing means being connected to said central processing unit, and said central processing unit being connected to said ball transfer means.

13. The roulette playing apparatus of claim 12, wherein said ball transfer means comprise a first electromagnetic mechanism having a core connected to a first bifurcated lever which supports said means for receiving said ball, said first bifurcated lever being rotatable between said trough and said ball launching station so that said means for receiving said ball can transfer said ball from said trough to said ball launching station.

14. The roulette playing apparatus of claim 13, wherein said ball launching station comprises a second spring-loaded electromagnetic mechanism having a ball launching position associated with operation of said second ball sensing means, said second spring-loaded electromagnetic mechanism having a core which is capable of striking said ball when said central processing unit receives a signal from said second sensing means which confirms that said ball is in said launching station.

15. The roulette playing apparatus of claim 14, wherein said ball guiding means is a trough inclined downwards from said roulette wheel, and said clutch is a friction clutch which can disconnect said two-speed drive means from said shaft under a command of said central processing unit.

16. The roulette playing apparatus of claim 15, wherein said indexing means comprise: an indexing wheel wherein said marking means comprise a plurality of positioning holes angular positions of which correspond to angular positions of said recesses on said roulette wheel; an indexing hole in said indexing wheel; fourth sensing means for detecting a starting position of said indexing wheel by means of said indexing hole; and fifth sensing means for detecting positions of said positioning holes, said fourth and said fifth sensing means being connected to said central processing unit.

17. The roulette playing apparatus of claim 16, wherein said means for raising said shaft comprises a third electromagnetic mechanism having a core and a second lever mechanism connected to said core, said third electromagnetic mechanism being connected to said central processing unit, said shaft resting on said second lever mechanism and being slidingly installed in said housing so that when said third electromagnetic mechanism is activated by a command from said central processing unit, said shaft is raised to a level from which said ball will drop onto said trough.

18. The roulette playing apparatus of claim 16, further comprising a shock detection means which is connected to said central processing unit for interrupting the game when a shock transmitted to said apparatus may change the results of the game.

* * * * *